US009127334B2

(12) United States Patent
Pandey

(10) Patent No.: US 9,127,334 B2
(45) **Date of Patent: *Sep. 8, 2015**

(54) DIRECT FORGING AND ROLLING OF $L1_2$ ALUMINUM ALLOYS FOR ARMOR APPLICATIONS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 753 days.

This patent is subject to a terminal disclaimer.

(21) Appl. No.: 12/437,183

(22) Filed: May 7, 2009

(65) Prior Publication Data

US 2010/0284853 A1 Nov. 11, 2010

(51) Int. Cl.

| | |
|---|---|
| ***C22C 1/04*** | (2006.01) |
| ***C22F 1/043*** | (2006.01) |
| ***C22C 1/05*** | (2006.01) |
| ***C22C 21/04*** | (2006.01) |
| ***C22C 1/02*** | (2006.01) |
| ***C22C 32/00*** | (2006.01) |
| ***F41H 5/04*** | (2006.01) |

(52) U.S. Cl.

CPC ... *C22C 1/05* (2013.01); *C22C 1/02* (2013.01); *C22C 1/0416* (2013.01); *C22C 21/04* (2013.01); *C22C 32/00* (2013.01); *C22F 1/043* (2013.01); *F41H 5/045* (2013.01); *F41H 5/0492* (2013.01); *B22F 2998/10* (2013.01)

(58) Field of Classification Search

CPC ..... C22C 21/00; C22C 21/04; C22F 1/043

USPC ..... 148/437–440, 549–552, 688, 698–702; 419/1, 26, 29, 48, 66; 420/529, 420/531–535, 537, 538, 540–553

See application file for complete search history.

(56) References Cited

U.S. PATENT DOCUMENTS

| | | | |
|---|---|---|---|
| 3,619,181 | A | 11/1971 | Willey et al. |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |

(Continued)

FOREIGN PATENT DOCUMENTS

| | | | |
|---|---|---|---|
| CN | 1436870 | A | 8/2003 |
| CN | 101205578 | A | 6/2008 |

(Continued)

OTHER PUBLICATIONS

Sanders, Robert E. "Aluminum and Aluminum Alloys." Kirk-Othmer Encyclopedia of Chemical Technology. Nov. 15, 2002.*

(Continued)

*Primary Examiner* — Brian Walck

(74) *Attorney, Agent, or Firm* — Kinney & Lange, P.A.

(57) ABSTRACT

A method for producing high strength $L1_2$ aluminum alloy armor plate comprises using gas atomization to produce powder that is then consolidated into $L1_2$ aluminum alloy billets. The billets are then forged or rolled into plate form. The powders include aluminum alloy with L12 A13X dispersoids where x is at least scandium, erbium, thulium, ytterbium, or lutetium, and at least gadolinium, yttrium, zirconium, titanium, hafnium, or niobium.

17 Claims, 13 Drawing Sheets

(56) References Cited

U.S. PATENT DOCUMENTS

| | | | |
|---|---|---|---|
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |
| 4,689,090 | A | 8/1987 | Sawtell et al. |
| 4,710,246 | A | 12/1987 | Le Caer et al. |
| 4,713,216 | A | 12/1987 | Higashi et al. |
| 4,755,221 | A | 7/1988 | Paliwal et al. |
| 4,832,741 | A | 5/1989 | Couper |
| 4,834,810 | A | 5/1989 | Benn et al. |
| 4,834,942 | A | 5/1989 | Frazier et al. |
| 4,853,178 | A | 8/1989 | Oslin |
| 4,865,806 | A | 9/1989 | Skibo et al. |
| 4,874,440 | A | 10/1989 | Sawtell et al. |
| 4,915,605 | A | 4/1990 | Chan et al. |
| 4,923,532 | A | 5/1990 | Zedalis et al. |
| 4,927,470 | A | 5/1990 | Cho |
| 4,933,140 | A | 6/1990 | Oslin |
| 4,946,517 | A | 8/1990 | Cho |
| 4,964,927 | A | 10/1990 | Shiflet et al. |
| 4,988,464 | A | 1/1991 | Riley |
| 5,032,352 | A | 7/1991 | Meeks et al. |
| 5,053,084 | A | 10/1991 | Masumoto et al. |
| 5,055,257 | A | 10/1991 | Chakrabarti |
| 5,059,390 | A | 10/1991 | Burleigh et al. |
| 5,066,342 | A | 11/1991 | Rioja et al. |
| 5,076,340 | A | 12/1991 | Bruski et al. |
| 5,076,865 | A | 12/1991 | Hashimoto et al. |
| 5,130,209 | A | 7/1992 | Das et al. |
| 5,133,931 | A | 7/1992 | Cho |
| 5,198,045 | A | 3/1993 | Cho et al. |
| 5,211,910 | A | 5/1993 | Pickens et al. |
| 5,226,983 | A | 7/1993 | Skinner et al. |
| 5,256,215 | A | 10/1993 | Horimura |
| 5,308,410 | A | 5/1994 | Horimura et al. |
| 5,312,494 | A | 5/1994 | Horimura et al. |
| 5,318,641 | A | 6/1994 | Masumoto et al. |
| 5,397,403 | A | 3/1995 | Horimura et al. |
| 5,458,700 | A | 10/1995 | Masumoto et al. |
| 5,462,712 | A | 10/1995 | Langan et al. |
| 5,480,470 | A | 1/1996 | Miller et al. |
| 5,532,069 | A | 7/1996 | Masumoto et al. |
| 5,597,529 | A | 1/1997 | Tack |
| 5,620,652 | A | 4/1997 | Tack et al. |
| 5,624,632 | A | 4/1997 | Baumann et al. |
| 5,882,449 | A | 3/1999 | Waldron et al. |
| 6,139,653 | A | 10/2000 | Fernandes et al. |
| 6,149,737 | A | 11/2000 | Hattori et al. |
| 6,248,453 | B1 | 6/2001 | Watson |
| 6,254,704 | B1 | 7/2001 | Laul et al. |
| 6,258,318 | B1 | 7/2001 | Lenczowski et al. |
| 6,309,594 | B1 | 10/2001 | Meeks, III et al. |
| 6,312,643 | B1 | 11/2001 | Upadhya et al. |
| 6,315,948 | B1 | 11/2001 | Lenczowski et al. |
| 6,331,218 | B1 | 12/2001 | Inoue et al. |
| 6,355,209 | B1 | 3/2002 | Dilmore et al. |
| 6,368,427 | B1 | 4/2002 | Sigworth |
| 6,506,503 | B1 | 1/2003 | Mergen et al. |
| 6,517,954 | B1 | 2/2003 | Mergen et al. |
| 6,524,410 | B1 | 2/2003 | Kramer et al. |
| 6,531,004 | B1 | 3/2003 | Lenczowski et al. |
| 6,562,154 | B1 | 5/2003 | Rioja et al. |
| 6,630,008 | B1 | 10/2003 | Meeks, III et al. |
| 6,702,982 | B1 | 3/2004 | Chin et al. |
| 6,902,699 | B2 | 6/2005 | Fritzemeier et al. |
| 6,918,970 | B2 | 7/2005 | Lee et al. |
| 6,974,510 | B2 | 12/2005 | Watson |
| 7,048,815 | B2 | 5/2006 | Senkov et al. |
| 7,097,807 | B1 | 8/2006 | Meeks, III et al. |
| 7,241,328 | B2 | 7/2007 | Keener |
| 7,344,675 | B2 | 3/2008 | Van Daam et al. |
| 2001/0054247 | A1 | 12/2001 | Stall et al. |
| 2003/0192627 | A1 | 10/2003 | Lee et al. |
| 2004/0046402 | A1 | 3/2004 | Winardi |
| 2004/0055671 | A1 | 3/2004 | Olson et al. |
| 2004/0089382 | A1 | 5/2004 | Senkov et al. |
| 2004/0170522 | A1 | 9/2004 | Watson |
| 2004/0191111 | A1 | 9/2004 | Nie et al. |
| 2005/0013725 | A1 | 1/2005 | Hsiao |
| 2005/0147520 | A1 | 7/2005 | Canzona |
| 2006/0011272 | A1 | 1/2006 | Lin et al. |
| 2006/0093512 | A1 | 5/2006 | Pandey |
| 2006/0172073 | A1 | 8/2006 | Groza et al. |
| 2006/0269437 | A1 | 11/2006 | Pandey |
| 2007/0048167 | A1 | 3/2007 | Yano |
| 2007/0062669 | A1 | 3/2007 | Song et al. |
| 2008/0066833 | A1 | 3/2008 | Lin et al. |

FOREIGN PATENT DOCUMENTS

| | | | |
|---|---|---|---|
| EP | 0 208 631 | A1 | 6/1986 |
| EP | 0 584 596 | A2 | 3/1994 |
| EP | 1 111 079 | A1 | 6/2001 |
| EP | 1 249 303 | A1 | 10/2002 |
| EP | 1 170 394 | B1 | 4/2004 |
| EP | 1 439 239 | A1 | 7/2004 |
| EP | 1 471 157 | A1 | 10/2004 |
| EP | 1 111 078 | B1 | 9/2006 |
| EP | 1 728 881 | A2 | 12/2006 |
| EP | 1 788 102 | A1 | 5/2007 |
| EP | 2110452 | A1 | 10/2009 |
| FR | 2 656 629 | A1 | 12/1990 |
| FR | 2843754 | A1 | 2/2004 |
| JP | 04218638 | A | 8/1992 |
| JP | 9104940 | A | 4/1997 |
| JP | 9279284 | A | 10/1997 |
| JP | 11156584 | A | 6/1999 |
| JP | 2000119786 | A | 4/2000 |
| JP | 2001038442 | A | 2/2001 |
| JP | 2006248372 | A | 9/2006 |
| JP | 2007188878 | A | 7/2007 |
| KR | 20040067608 | A | 7/2004 |
| RU | 2001144 | C1 | 10/1993 |
| RU | 2001145 | C1 | 10/1993 |
| WO | 90 02620 | A1 | 3/1990 |
| WO | 91 10755 | A2 | 7/1991 |
| WO | 9111540 | A1 | 8/1991 |
| WO | 9532074 | A2 | 11/1995 |
| WO | WO9610099 | A1 | 4/1996 |
| WO | 9833947 | A1 | 8/1998 |
| WO | 00 37696 | A1 | 6/2000 |
| WO | 0112868 | A1 | 2/2001 |
| WO | 02 29139 | A2 | 4/2002 |
| WO | 03 052154 | A1 | 6/2003 |
| WO | 03085145 | A2 | 10/2003 |
| WO | 03085146 | A1 | 10/2003 |
| WO | 03 104505 | A2 | 12/2003 |
| WO | 2004 005562 | A2 | 1/2004 |
| WO | 2004046402 | A2 | 5/2004 |
| WO | 2005 045080 | A1 | 5/2005 |
| WO | 2005475554 | A1 | 5/2005 |

OTHER PUBLICATIONS

J.W. Bray, Aluminum Mill and Engineered Wrought Products, Properties and Selection: Nonferrous Alloys and Special-Purpose Materials, vol. 2, ASM Handbook, ASM International, 1990, p. 29-61.*

Cabbibo, M. et al., "A TEM study of the combined effect of severe plastic deformation and (Zr), (Sc+Zr)-containing dispersoids on an Al-Mg-Si alloy." Journal of Materials Science, vol. 41, No. 16, Jun. 6, 2006. pp. 5329-5338.

Litynska-Dobrzynska, L. "Effect of heat treatment on the sequence of phases formation in Al-Mg-Si alloy with Sc and Zr additions." Archives of Metallurgy and Materials. 51 (4), pp. 555-560, 2006.

Litynska-Dobrzynska, L. "Precipitation of Phases in Al-Mg-Si-Cu Alloy with Sc and Zr and Zr Additions During Heat Treatment" Diffusion and Defect Data, Solid State Data, Part B, Solid Statephenomena. vol. 130, No. Applied Crystallography, Jan. 1, 2007. pp. 163-166.

(56) References Cited

OTHER PUBLICATIONS

Cook, R., et al. "Aluminum and Aluminum Alloy Powders for P/M Applications." The Aluminum Powder Company Limited, Ceracon Inc.
"Aluminum and Aluminum Alloys." ASM Specialty Handbook. 1993. ASM International. p. 559.
Gangopadhyay, A.K., et al. "Effect of rare-earth atomic radius on the devitrification of AI88RE8Ni4 amorphous alloys." Philosophical Magazine A, 2000, vol. 80, No. 5, pp. 1193-1206.
Riddle, Y.W., et al. "Improving Recrystallization Resistance in WRought Aluminum Alloys with Scandium Addition." Lightweight Alloys for Aerospace Applications VI (pp. 26-39), 2001 TMS Annual Meeting, New Orleans, Louisiana, Feb. 11-15, 2001.
Baikowski Malakoff Inc. "The many uses of High Purity Alumina." Technical Specs. http://www.baikowskimalakoff.com/pdf/Rc-Ls.pdf (2005).
Lotsko, D.V., et al. "Effect of small additions of transition metals on the structure of Al-Zn-Mg-Zr-Sc alloys." New Level of Properties. Advances in Insect Physiology. Academic Press, vol. 2, Nov. 4, 2002. pp. 535-536.
Neikov, O.D., et al. "Properties of rapidly solidified powder aluminum alloys for elevated temperatures produced by water atomization." Advances in Powder Metallurgy & Particulate Materials. 2002. pp. 7-14-7-27.
Harada, Y. et al. "Microstructure of Al3Sc with ternary transition-metal additions." Materials Science and Engineering A329-331 (2002) 686-695.
Unal, A. et al. "Gas Atomization" from the section "Production of Aluminum and Aluminum-Alloy Powder" ASM Handbook, vol. 7. 2002.
Riddle, Y.W., et al. "A Study of Coarsening, Recrystallization, and Morphology of Microstructure in Al-Sc-(Zr)-(Mg) Alloys." Metallurgical and Materials Transactions A. vol. 35A, Jan. 2004. pp. 341-350.
Mil'Man, Y.V. et al. "Effect of Additional Alloying with Transition Metals on the STructure of an Al-7.1 Zn-1.3 Mg-0.12 Zr Alloy." Metallofizika I Noveishie Teknohologii, 26 (10), 1363-1378, 2004.
Tian, N. et al. "Heating rate dependence of glass transition and primary crystallization of Al88Gd6Er2Ni4 metallic glass." Scripta Materialia 53 (2005) pp. 681-685.
Litynska, L. et al. "Experimental and theoretical characterization of Al3Sc precipitates in Al-Mg-Si-Cu-Sc-Zr alloys." Zeitschrift Fur Metallkunde. vol. 97, No. 3. Jan. 1, 2006. pp. 321-324.
Rachek, O.P. "X-ray diffraction study of amorphous alloys Al-Ni-Ce-Sc with using Ehrenfest's formula." Journal of Non-Crystalline Solids 352 (2006) pp. 3781-3786.
Pandey A B et al, "High Strength Discontinuously Reinforced Aluminum for Rocket Applications," Affordable Metal Matrix Composites for High Performance Applications. Symposia Proceedings, TMS (The Minerals, Metals & Materials Society), US, No. 2nd, Jan. 1, 2008, pp. 3-12.
Niu, Ben et al. "Influence of addition of 1-15 erbium on microstructure and crystallization behavior of Al-Ni-Y amorphous alloy" Zhongguo Xitu Xuebao, 26(4), pp. 450-454. 2008.
Riddle, Y.W., et al. "Recrystallization Performance of AA7050 Varied with Sc and Zr." Materials Science Forum. 2000. pp. 799-804.
Lotsko, D.V., et al. "High-strength aluminum-based alloys hardened by quasicrystalline nanoparticles." Science for Materials in the Frontier of Centuries: Advantages and Challenges, International Conference: Kyiv, Ukraine. Nov. 4-8, 2002. vol. 2. pp. 371-372.
Hardness Conversion Table. Downloaded from http://www.gordonengland.co.uk/hardness/hardness_conversion_2m.htm.
ASM Handbook, vol. 7, ASM International, Materials Park, OH (1998) p. 396.

* cited by examiner

DIRECT FORGING AND ROLLING OF $L1_2$ ALUMINUM ALLOYS FOR ARMOR APPLICATIONS

CROSS-REFERENCE TO RELATED APPLICATION(S)

This application is related to the following co-pending applications that were filed on Dec. 9, 2008 herewith and are assigned to the same assignee: CONVERSION PROCESS FOR HEAT TREATABLE $L1_2$ ALUMINUM ALLOYS, Ser. No. 12/316,020; A METHOD FOR FORMING HIGH STRENGTH ALUMINUM ALLOYS CONTAINING $L1_2$ INTERMETALLIC DISPERSOIDS, Ser. No. 12/316,046; and A METHOD FOR PRODUCING HIGH STRENGTH ALUMINUM ALLOY POWDER CONTAINING $L1_2$ INTERMETALLIC DISPERSOIDS, Ser. No. 12/316,047.

This application is also related to the following co-pending applications that were filed on Apr. 18, 2008, and are assigned to the same assignee: $L1_2$ ALUMINUM ALLOYS WITH BIMODAL AND TRIMODAL DISTRIBUTION, Ser. No. 12/148,395; DISPERSION STRENGTHENED $L1_2$ ALUMINUM ALLOYS, Ser. No. 12/148,432; HEAT TREATABLE $L1_2$ ALUMINUM ALLOYS, Ser. No. 12/148,383; HIGH STRENGTH $L1_2$ ALUMINUM ALLOYS, Ser. No. 12/148,394; HIGH STRENGTH $L1_2$ ALUMINUM ALLOYS, Ser. No. 12/148,382; HEAT TREATABLE $L1_2$ ALUMINUM ALLOYS, Ser. No. 12/148,396; HIGH STRENGTH $L1_2$ ALUMINUM ALLOYS, Ser. No. 12/148,387; HIGH STRENGTH ALUMINUM ALLOYS WITH $L1_2$ PRECIPITATES, Ser. No. 12/148,426; HIGH STRENGTH $L1_2$ ALUMINUM ALLOYS, Ser. No. 12/148,459; and $L1_2$ STRENGTHENED AMORPHOUS ALUMINUM ALLOYS, Ser. No. 12/148,458.

BACKGROUND

The present invention relates generally to aluminum alloys and more specifically to a method for forming high strength aluminum alloy powder having $L1_2$ dispersoids therein into plate form for armor applications.

Metals for armor applications need exceptional yield and tensile strengths to resist plastic deformation as well as high fracture toughness to resist fracture during ballistic impact. Aluminum alloys are candidates because of their low density and have been used extensively since the latter half of the twentieth century as ballistic protection in all forms of battlefield structures, particularly vehicles. Popular aluminum armor systems currently in use are based on Al—Mg—Mn—Cr and Al—Zn—Mg—Zr alloy chemistries. Examples are 5083 and 7039 alloys in the cold worked and precipitation hardened conditions, respectively.

The mechanical properties of any alloy system depend directly on the microstructure. Strength is a function of grain size, alloy content, and second phase morphology and distribution. Small grain size, maximum solid solution strengthening and optimum concentration and morphology of disbursed second phases are important parameters when maximizing candidate armor systems. Aluminum alloys produced from powder precursors have small grain sizes, extended solid solubility and excellent second phase particle dispersions resulting in very high strengths and therefore, are candidates for armor applications.

Recent work with aluminum alloys containing coherent $LI_2$ dispersed intermetallic phases that exhibit stable elevated temperature properties has shown the alloys to possess properties that make them candidates for armor applications. U.S. Pat. No. 6,248,453 discloses aluminum alloys strengthened by dispersed $Al_3X$ $L1_2$ intermetallic phases where X is selected from the group consisting of Sc, Er, Lu, Yb, Tm, and Lu. The $Al_3X$ particles are coherent with the aluminum alloy matrix and are resistant to coarsening at elevated temperatures. U.S. Patent Application Publication No. 2006/0269437 A1 discloses a high strength aluminum alloy that contains scandium and other elements that is strengthened by $L1_2$ dispersoids. $L1_2$ strengthened aluminum alloys have high strength and improved fatigue and fracture properties compared to commercial aluminum alloys. Fine grain size results in improved mechanical properties of materials. Hall-Petch strengthening has been known for decades where strength increases as grain size decreases. An optimum grain size for optimum strength is in the nano range of about 30 to 100 nm. These alloys also have lower ductility.

SUMMARY

The present invention is a method for consolidating aluminum alloy powders into useful components with strength and fracture toughness suitable for armor applications. In embodiments, powders include an aluminum alloy having coherent $L1_2$ $Al_3X$ dispersoids where X is at least one first element selected from scandium, erbium, thulium, ytterbium, and lutetium, and at least one second element selected from gadolinium, yttrium, zirconium, titanium, hafnium, and niobium. The balance is substantially aluminum containing at least one alloying element selected from silicon, magnesium, lithium, copper, zinc, and nickel.

The armor material is then formed by consolidation of an aluminum alloy powder containing $L1_2$ dispersoids into rectangular preforms and vacuum hot pressing or hot isostatic pressing (HIP) the preforms to full density billets. The billets are then hot forged or hot rolled to produce $L1_2$ aluminum alloy armor plate.

DETAILED DESCRIPTION

1. $L1_2$ Aluminum Alloys

Figure 1:
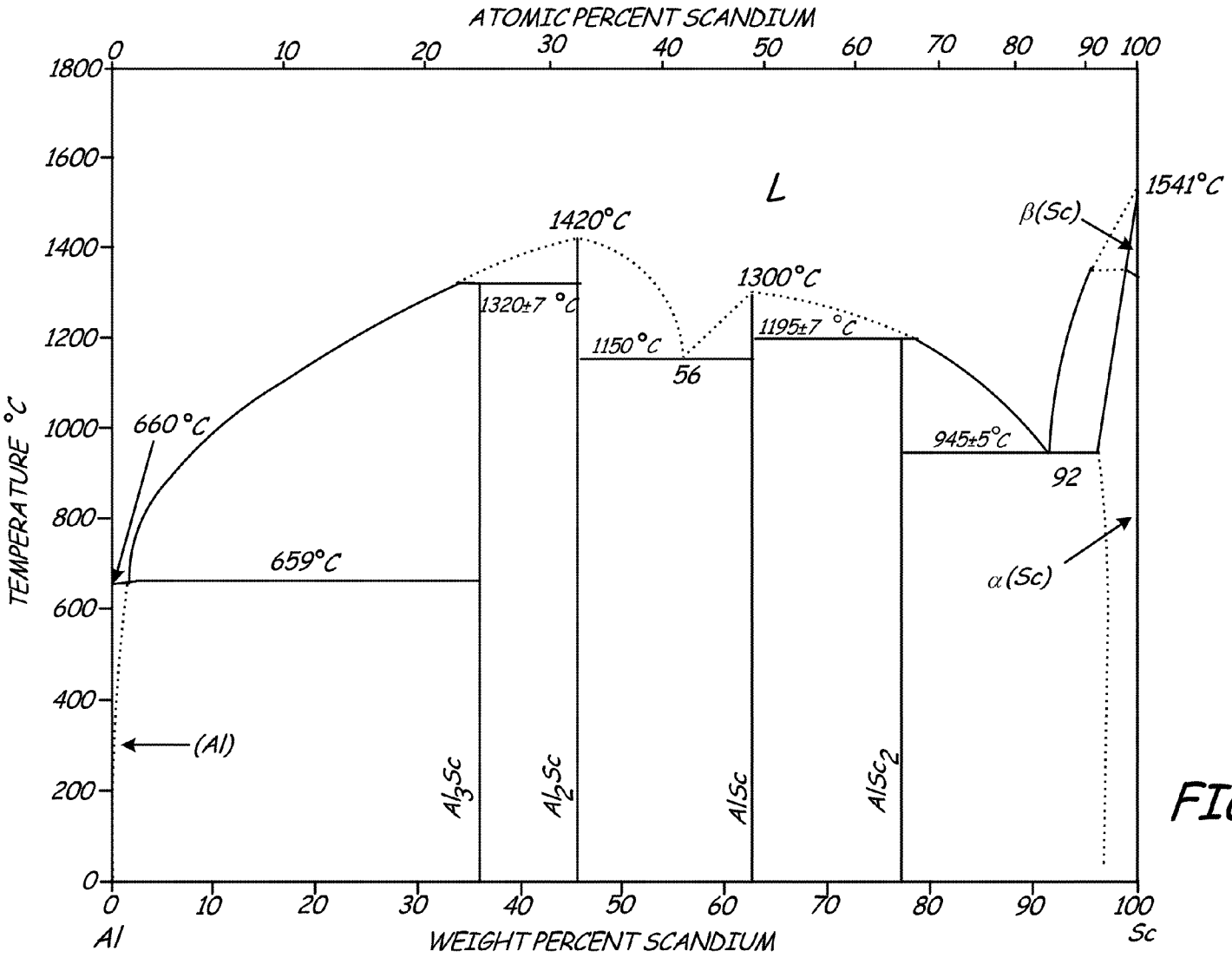
FIG. 1 is an aluminum scandium phase diagram.

Alloy powders refined by this invention are formed from aluminum based alloys with high strength and fracture toughness for applications at temperatures from about −420° F. (−251° C.) up to about 650° F. (343° C.). The aluminum alloy comprises a solid solution of aluminum and at least one element selected from silicon, magnesium, lithium, copper, zinc, and nickel strengthened by $L1_2$ $Al_3X$ coherent precipitates where X is at least one first element selected from scandium, erbium, thulium, ytterbium, and lutetium, and at least one second element selected from gadolinium, yttrium, zirconium, titanium, hafnium, and niobium.

The aluminum silicon system is a simple eutectic alloy system with a eutectic reaction at 12.5 weight percent silicon and 1077° F. (577° C.). There is little solubility of silicon in aluminum at temperatures up to 930° F. (500° C.) and none of aluminum in silicon. However, the solubility can be extended significantly by utilizing rapid solidification techniques The binary aluminum magnesium system is a simple eutectic at 36 weight percent magnesium and 842° F. (450° C.). There is complete solubility of magnesium and aluminum in the rapidly solidified inventive alloys discussed herein.

The binary aluminum lithium system is a simple eutectic at 8 weight percent lithium and 1105° (596° C.). The equilibrium solubility of 4 weight percent lithium can be extended significantly by rapid solidification techniques. There can be complete solubility of lithium in the rapid solidified inventive alloys discussed herein.

The binary aluminum copper system is a simple eutectic at 32 weight percent copper and 1018° F. (548° C.). There can be complete solubility of copper in the rapidly solidified inventive alloys discussed herein.

The aluminum zinc binary system is a eutectic alloy system involving a monotectoid reaction and a miscibility gap in the solid state. There is a eutectic reaction at 94 weight percent zinc and 718° F. (381° C.). Zinc has maximum solid solubility of 83.1 weight percent in aluminum at 717.8° F. (381° C.), which can be extended by rapid solidification processes. Decomposition of the super saturated solid solution of zinc in aluminum gives rise to spherical and ellipsoidal GP zones, which are coherent with the matrix and act to strengthen the alloy.

The aluminum nickel binary system is a simple eutectic at 5.7 weight percent nickel and 1183.8° F. (639.9° C.). There is little solubility of nickel in aluminum. However, the solubility can be extended significantly by utilizing rapid solidification processes. The equilibrium phase in the aluminum nickel eutectic system is $L1_2$ intermetallic $Al_3Ni$.

In the aluminum based alloys disclosed herein, scandium, erbium, thulium, ytterbium, and lutetium are potent strengtheners that have low diffusivity and low solubility in aluminum. All these elements form equilibrium $Al_3X$ intermetallic dispersoids where X is at least one of scandium, erbium, thulium, ytterbium, and lutetium, that have an $L1_2$ structure that is an ordered face centered cubic structure with the X atoms located at the corners and aluminum atoms located on the cube faces of the unit cell.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Sc$ to coarsening. Additions of zinc, copper, lithium, silicon, and nickel provide solid solution and precipitation strengthening in the aluminum alloys. These $Al_3Sc$ dispersoids are made stronger and more resistant to coarsening at elevated temperatures by adding suitable alloying elements such as gadolinium, yttrium, zirconium, titanium, hafnium, niobium, or combinations thereof that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Er$ to coarsening. Additions of zinc, copper, lithium, silicon, and nickel provide solid solution and precipitation strengthening in the aluminum alloys. These $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Tm$ to coarsening. Additions of zinc, copper, lithium, silicon, and nickel provide solid solution and precipitation strengthening in the aluminum alloys. These $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Yb$ to coarsening. Additions of zinc, copper, lithium, silicon, and nickel provide solid solution and precipitation strengthening in the aluminum alloys. These $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Lu$ to coarsening. Additions of zinc, copper, lithium, silicon, and nickel provide solid solution and precipitation strengthening in the aluminum alloys. These $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient, which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids, which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient, which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $D0_{22}$ structure in the equilibrium condition. The metastable $Al_3Ti$ despersoids have a low diffusion coefficient, which makes them thermally stable and highly resistant to coarsening. Titanium has a high solubility in the $Al_3X$ dispersoids allowing large amounts of titanium to substitute for X in the $Al_3X$ dispersoids, which result in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above-mentioned $Al_3X$ dispersoids, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

$Al_3X$ $L1_2$ precipitates improve elevated temperature mechanical properties in aluminum alloys for two reasons. First, the precipitates are ordered intermetallic compounds. As a result, when the particles are sheared by glide dislocations during deformation, the dislocations separate into two partial dislocations separated by an anti-phase boundary on the glide plane. The energy to create the anti-phase boundary is the origin of the strengthening. Second, the cubic $L1_2$ crystal structure and lattice parameter of the precipitates are closely matched to the aluminum solid solution matrix. This results in a lattice coherency at the precipitate/matrix boundary that resists coarsening. The lack of an interphase boundary results in a low driving force for particle growth and resulting elevated temperature stability. Alloying elements in solid solution in the dispersed strengthening particles and in the aluminum matrix that tend to decrease the lattice mismatch between the matrix and particles will tend to increase the strengthening and elevated temperature stability of the alloy.

$L1_2$ phase strengthened aluminum alloys are important structural materials because of their excellent mechanical properties and the stability of these properties at elevated temperature due to the resistance of the coherent dispersoids in the microstructure to particle coarsening. The mechanical properties are optimized by maintaining a high volume fraction of $L1_2$ dispersoids in the microstructure. The $L1_2$ dispersoid concentration following aging scales as the amount of $L1_2$ phase forming elements in solid solution in the aluminum alloy following quenching. Examples of $L1_2$ phase forming elements include but are not limited to Sc, Er, Th, Yb, and Lu. The concentration of alloying elements in solid solution in alloys cooled from the melt is directly proportional to the cooling rate.

Exemplary aluminum alloys for the bimodal system alloys of this invention include, but are not limited to (in weight percent unless otherwise specified):

about Al-M-(0.1-4)Sc-(0.1-20)Gd;
about Al-M-(0.1-20)Er-(0.1-20)Gd;
about Al-M-(0.1-15)Tm-(0.1-20)Gd;
about Al-M-(0.1-25)Yb-(0.1-20)Gd;
about Al-M-(0.1-25)Lu-(0.1-20)Gd;
about Al-M-(0.1-4)Sc-(0.1-20)Y;
about Al-M-(0.1-20)Er-(0.1-20)Y;
about Al-M-(0.1-15)Tm-(0.1-20)Y;
about Al-M-(0.1-25)Yb-(0.1-20)Y;
about Al-M-(0.1-25)Lu-(0.1-20)Y;
about Al-M-(0.1-4)Sc-(0.05-4)Zr;
about Al-M-(0.1-20)Er-(0.05-4)Zr;
about Al-M-(0.1-15)Tm-(0.05-4)Zr;
about Al-M-(0.1-25)Yb-(0.05-4)Zr;
about Al-M-(0.1-25)Lu-(0.05-4)Zr;
about Al-M-(0.1-4)Sc-(0.05-10)Ti;
about Al-M-(0.1-20)Er-(0.05-10)Ti;
about Al-M-(0.1-15)Tm-(0.05-10)Ti;
about Al-M-(0.1-25)Yb-(0.05-10)Ti;
about Al-M-(0.1-25)Lu-(0.05-10)Ti;
about Al-M-(0.1-4)Sc-(0.05-10)Hf;
about Al-M-(0.1-20)Er-(0.05-10)Hf;
about Al-M-(0.1-15)Tm-(0.05-10)Hf;
about Al-M-(0.1-25)Yb-(0.05-10)Hf;
about Al-M-(0.1-25)Lu-(0.05-10)Hf;
about Al-M-(0.1-4)Sc-(0.05-5)Nb;
about Al-M-(0.1-20)Er-(0.05-5)Nb;
about Al-M-(0.1-15)Tm-(0.05-5)Nb;

about Al-M-(0.1-25)Yb-(0.05-5)Nb; and about Al-M-(0.1-25)Lu-(0.05-5)Nb.

M is at least one of about (4-25) weight percent silicon, (1-8) weight percent magnesium, (0.5-3) weight percent lithium, (0.2-6.5) weight percent copper, (3-12) weight percent zinc, and (1-12) weight percent nickel.

The amount of silicon present in the fine grain matrix, if any, may vary from about 4 to about 25 weight percent, more preferably from about 4 to about 18 weight percent, and even more preferably from about 5 to about 11 weight percent.

The amount of magnesium present in the fine grain matrix, if any, may vary from about 1 to about 8 weight percent, more preferably from about 3 to about 7.5 weight percent, and even more preferably from about 4 to about 6.5 weight percent.

The amount of lithium present in the fine grain matrix, if any, may vary from about 0.5 to about 3 weight percent, more preferably from about 1 to about 2.5 weight percent, and even more preferably from about 1 to about 2 weight percent.

The amount of copper present in the fine grain matrix, if any, may vary from about 0.2 to about 6.5 weight percent, more preferably from about 0.5 to about 5.0 weight percent, and even more preferably from about 2 to about 4.5 weight percent.

The amount of zinc present in the fine grain matrix, if any, may vary from about 3 to about 12 weight percent, more preferably from about 4 to about 10 weight percent, and even more preferably from about 5 to about 9 weight percent.

The amount of nickel present in the fine grain matrix, if any, may vary from about 1 to about 12 weight percent, more preferably from about 2 to about 10 weight percent, and even more preferably from about 4 to about 10 weight percent.

The alloys may also include at least one ceramic reinforcement. Aluminum oxide, silicon carbide, boron carbide, aluminum nitride, titanium boride, titanium diboride and titanium carbide are suitable ceramic reinforcements. Effective particle sizes for the ceramic reinforcements are from about 0.5 to about 50 microns.

The amount of scandium present in the fine grain matrix, if any, may vary from 0.1 to about 4 weight percent, more preferably from about 0.1 to about 3 weight percent, and even more preferably from about 0.2 to about 2.5 weight percent. The Al—Sc phase diagram shown in FIG. 1 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3}$° C./second.

Figure 2:
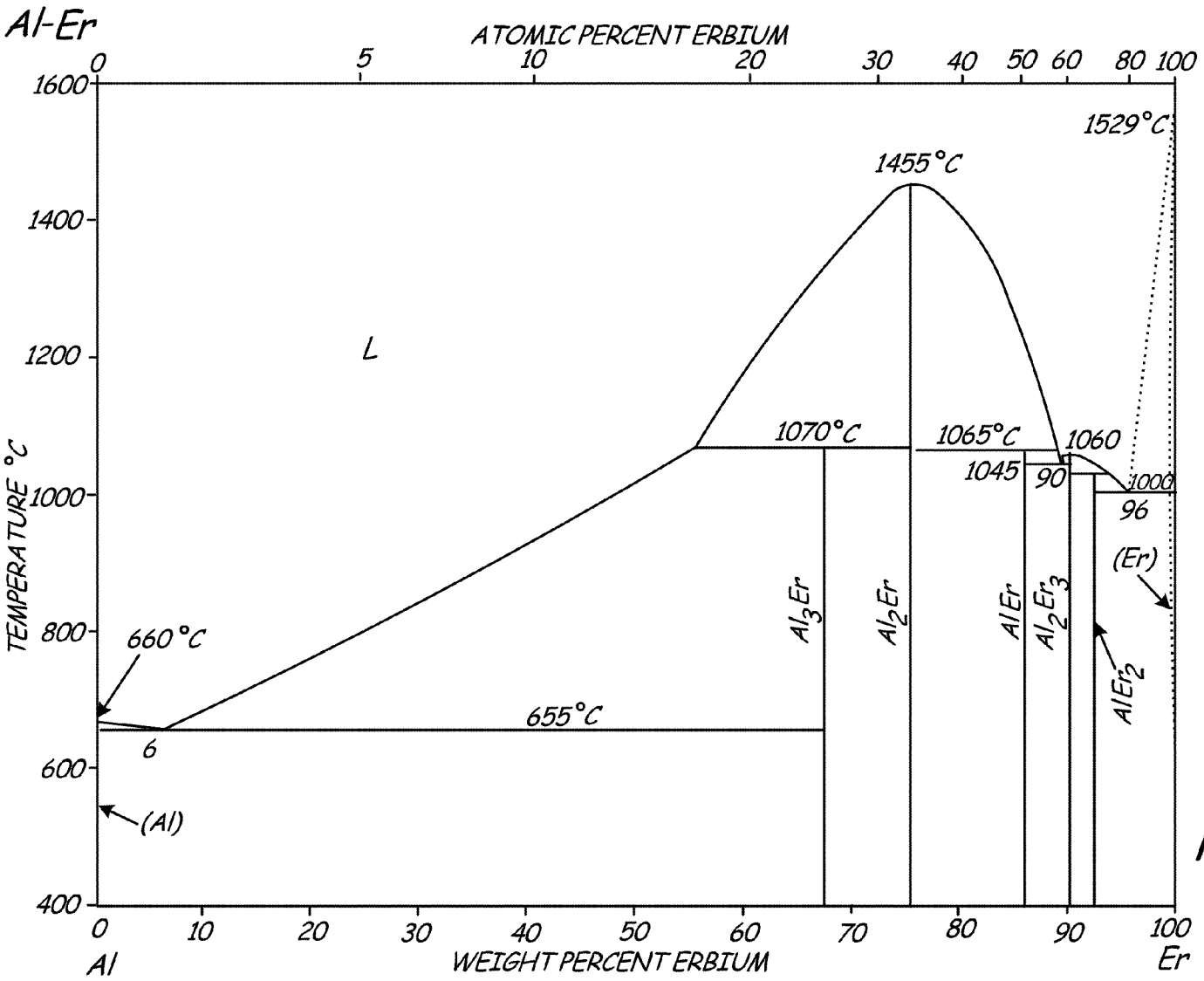
FIG. 2 is an aluminum erbium phase diagram.

The amount of erbium present in the fine grain matrix, if any, may vary from about 0.1 to about 20 weight percent, more preferably from about 0.3 to about 15 weight percent, and even more preferably from about 0.5 to about 10 weight percent. The Al—Er phase diagram shown in FIG. 2 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3}$° C./second.

Figure 3:
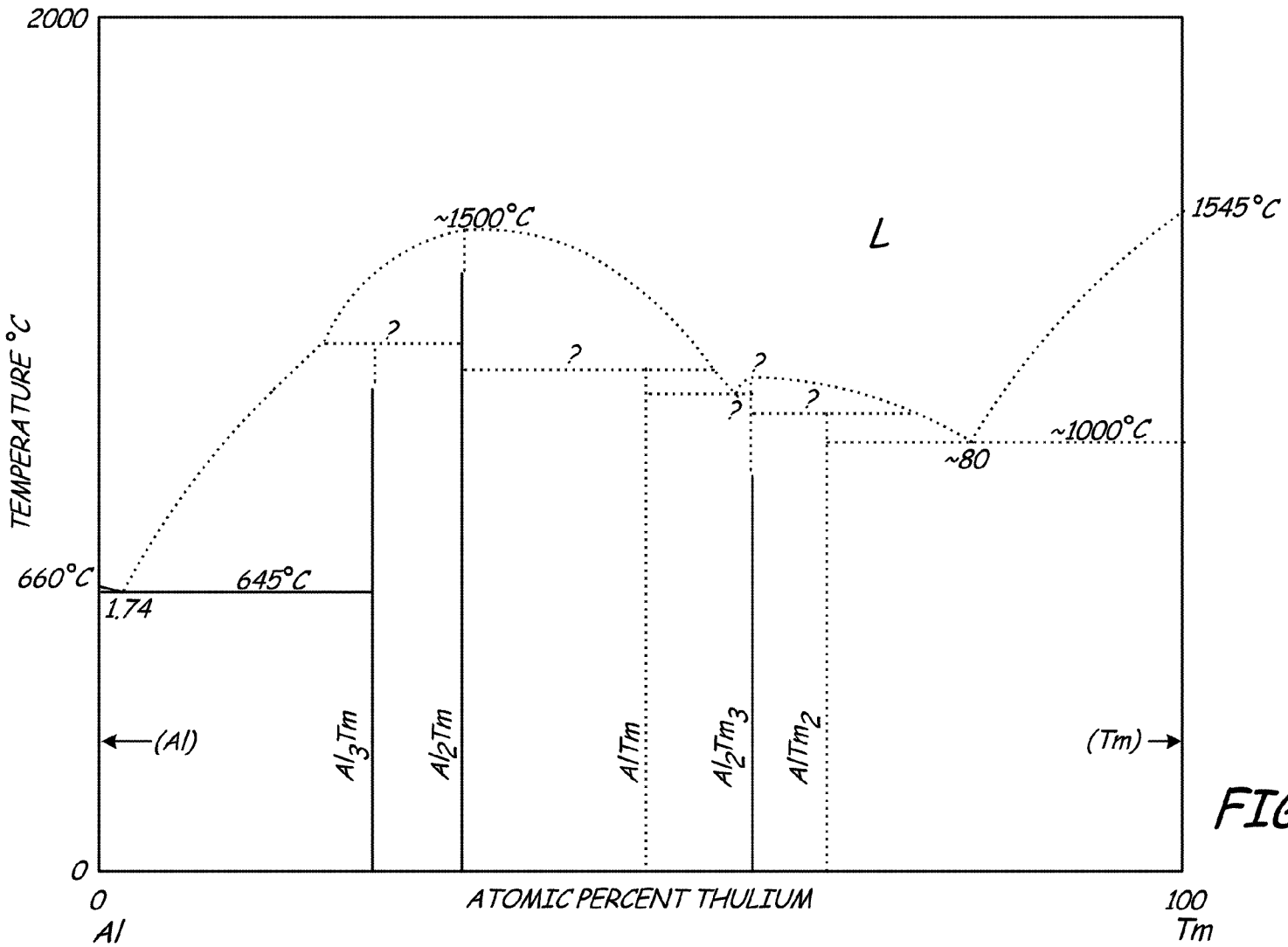
FIG. 3 is an aluminum thulium phase diagram.
Figure 4:
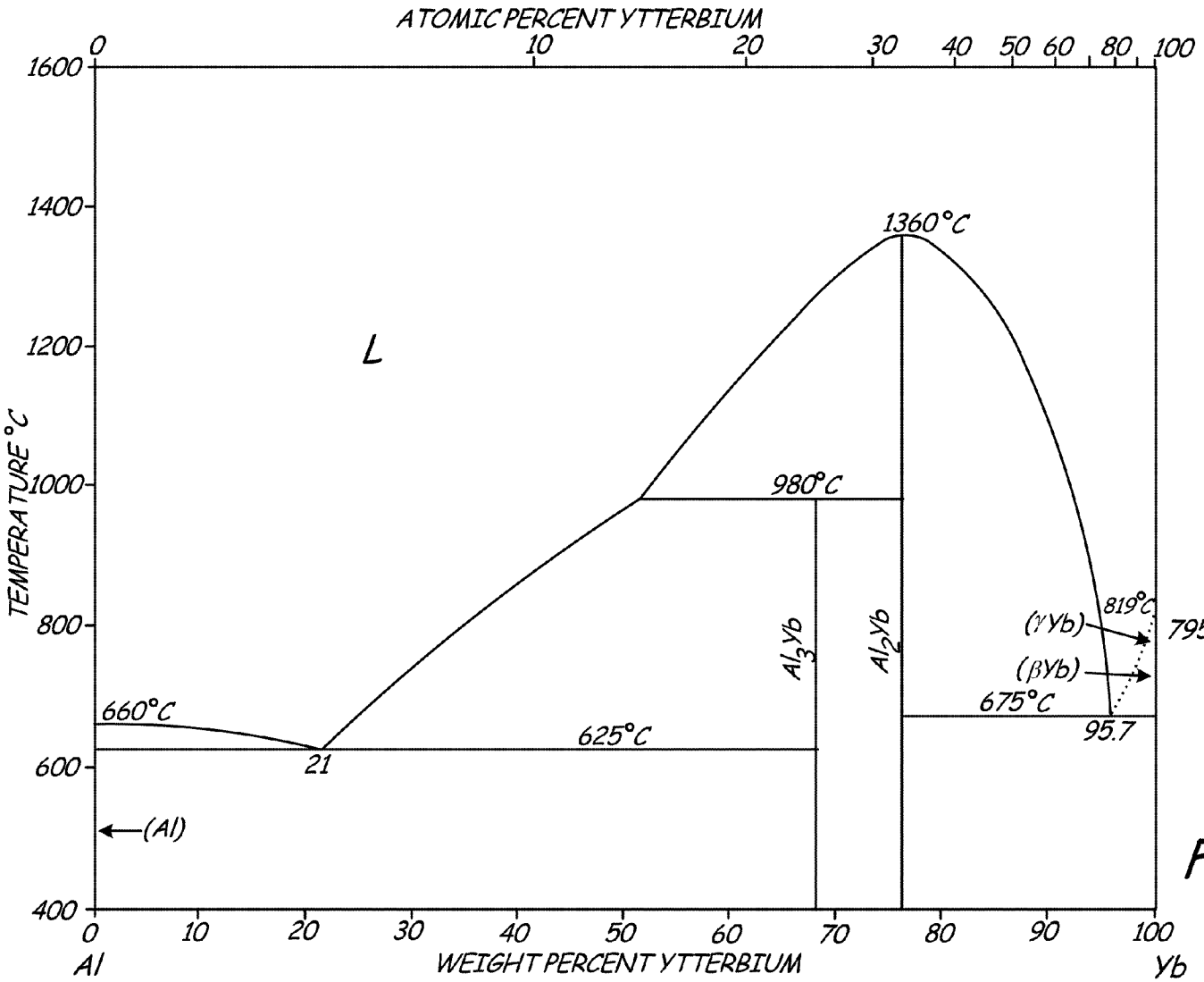
FIG. 4 is an aluminum ytterbium phase diagram.
Figure 5:
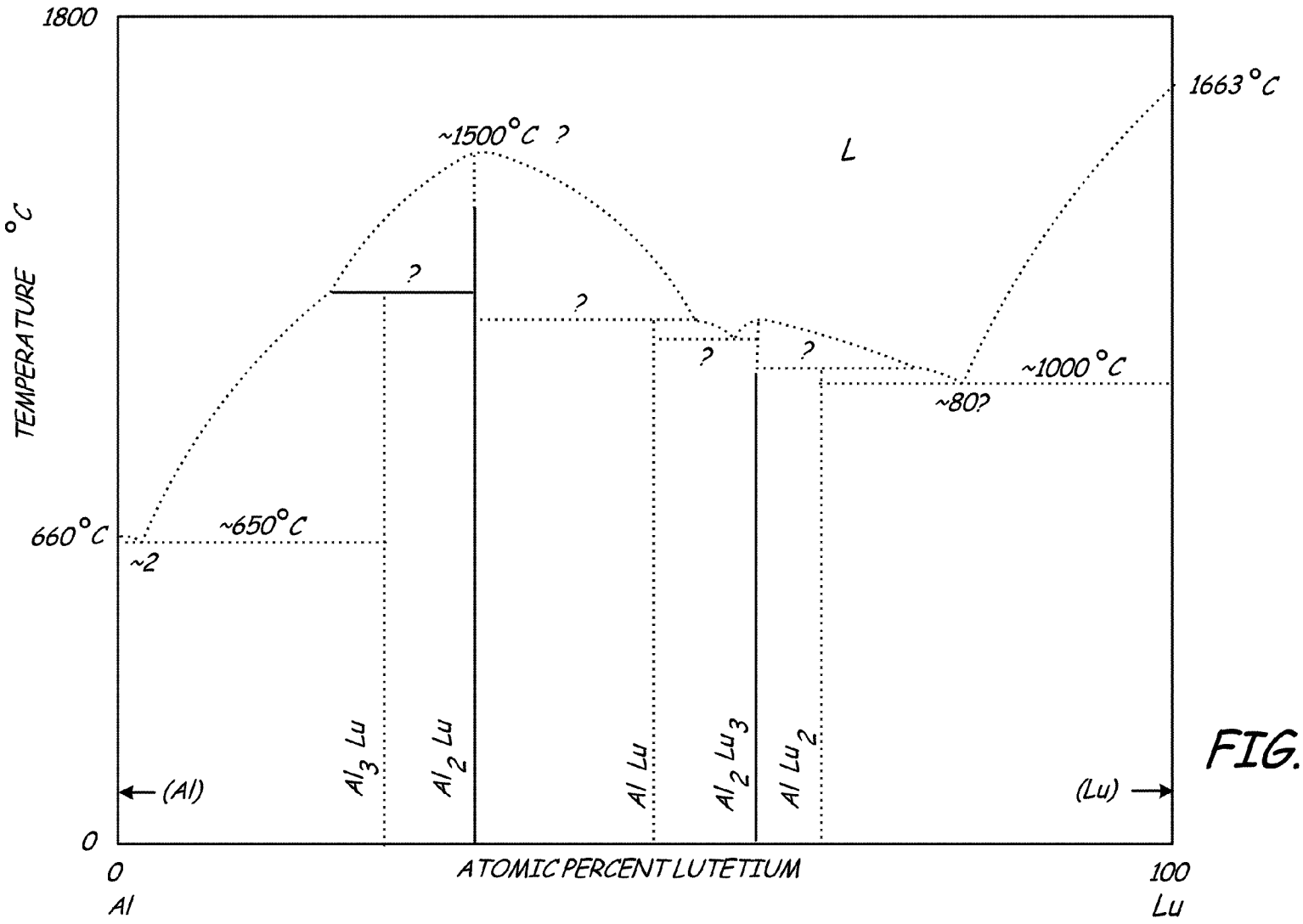
FIG. 5 is an aluminum lutetium phase diagram.

The amount of thulium present in the alloys, if any, may vary from about 0.1 to about 15 weight percent, more preferably from about 0.2 to about 10 weight percent, and even more preferably from about 0.4 to about 6 weight percent. The Al—Tm phase diagram shown in FIG. 3 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient, which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3}$° C./second.

2. Forming Aluminum $L1_2$ Alloy Powder into Armor Plate

The $L1_2$ aluminum alloys described herein have mechanical properties that make them ideal for lightweight armor applications. As discussed later, the alloys exhibit both yield and tensile strengths exceeding 100 ksi (690 MPa) and toughness values of 22 ksi $in^{1/2}$ (24.2 MPa $m^{1/2}$). These strength values exceed those of conventional aluminum alloy armor by 30-40% for similar toughness values. In addition, the submicron microstructure of these alloys comprising coherent $L1_2$ dispersoids in a highly alloyed aluminum matrix is easily shaped by deformation processing and is thermally stable.

A major reason for the success of the alloys is that they depend on powder precursors. Powder production by gas atomization allows the high levels of solid state alloy supersaturation leading to the concentration and distribution of submicron $L1_2$ phases responsible for the excellent mechanical strength and toughness exhibited by these alloys systems.

Figure 6:
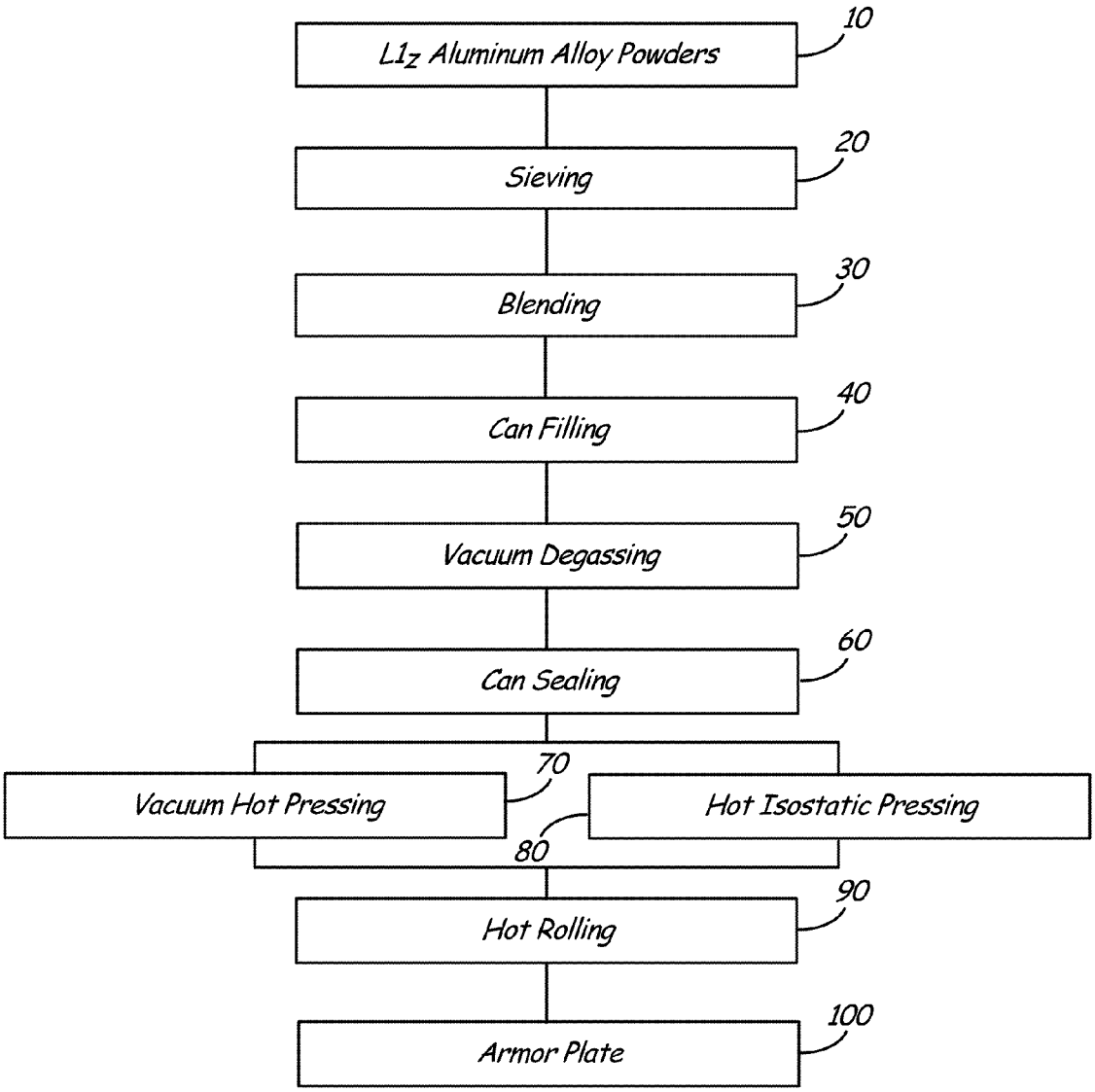
FIG. 6 is a diagram showing the processing steps to consolidate $L1_2$ aluminum alloy powder into armor plate.

The process of forming lightweight armor plates from $L1_2$ aluminum alloy powder is shown in FIG. 6. After powder production (step 10) the powders are classified according to size by sieving (step 20). Next the classified powders are blended (step 30) in order to maintain microstructural homogeneity in the final part. The sieved and blended powders are then put in a can with a rectangular geometry (step 40) and vacuum degassed (step 50). Following vacuum degassing (step 50) the can is sealed under vacuum (step 60). The powders in the can are then consolidated into billets by either vacuum hot pressing in a closed die (step 70) or hot isostatic pressing (step 80). Following consolidation the billets are hot rolled (step 90) into armor plate (step 100). These steps are described in order in what follows $L1_2$ Aluminum Alloy Powder Formation.

It is important to have a high cooling rate during powder formation to maintain the high alloy supersaturation necessary for the formation of dispersed submicron coherent $L1_2$ second phase particles for strengthening. The highest cooling rates observed in commercially viable processes are achieved by gas atomization of molten metals to produce powder. Gas atomization is a two fluid process wherein a stream of molten metal is disintegrated by a high velocity gas stream. The end result is that the particles of molten metal eventually become spherical due to surface tension and finely solidify in powder form. Heat from the liquid droplets is transferred to the atomization gas by convection. The solidification rates, depending on the gas and the surrounding environment, can be very high and can exceed $10^{6}$° C./second. Cooling rates greater than $10^{3}$° C./second are typically specified to ensure supersaturation of alloying elements in gas atomized $L1_2$ aluminum alloy powder in the inventive process described herein.

Figure 7A:
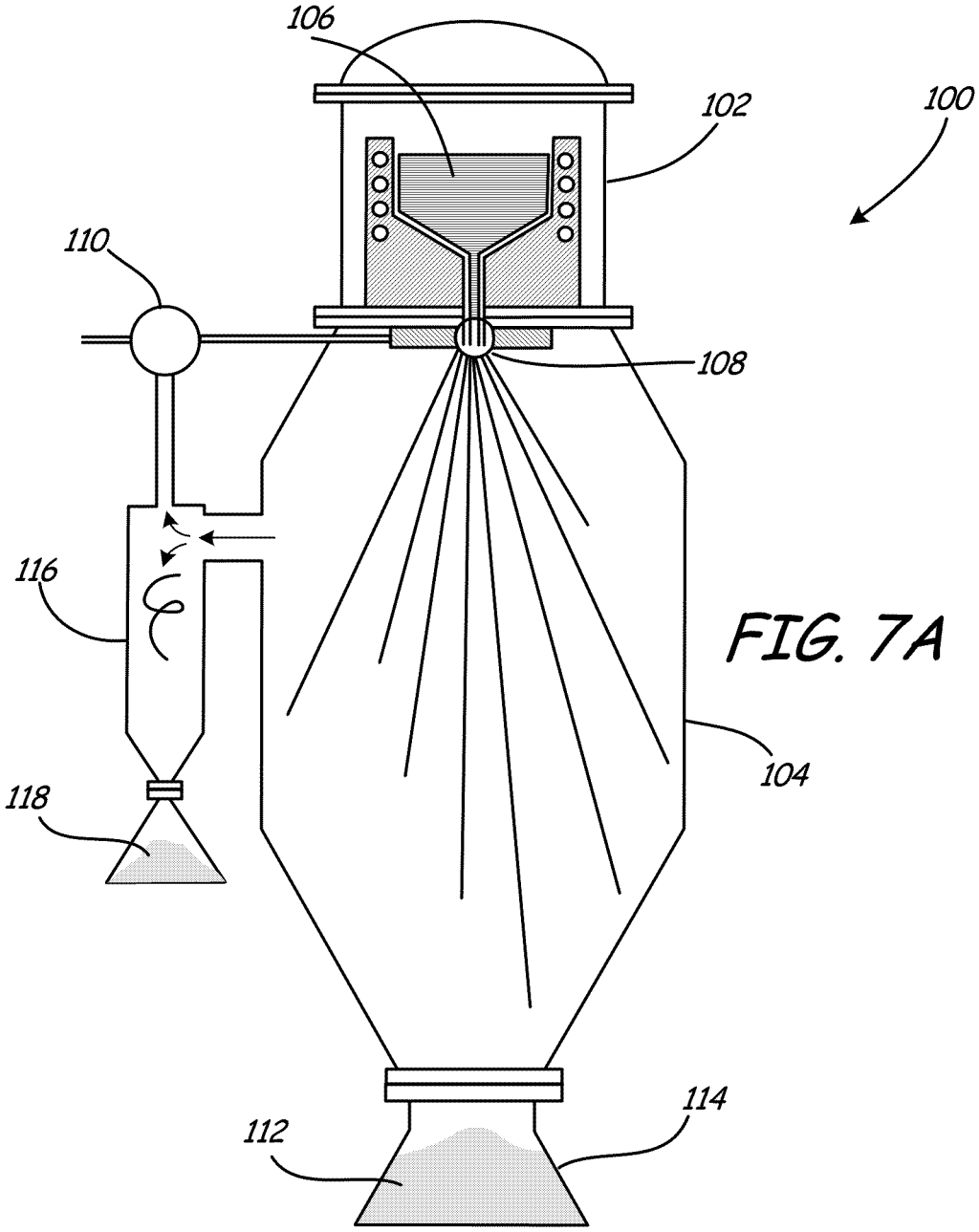
FIG. 7A is a schematic diagram of a vertical gas atomizer.
Figure 7B:
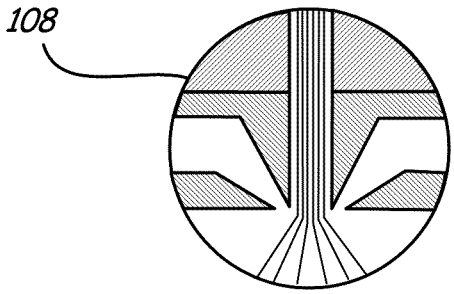
FIG. 7B is a close up view of nozzle 10B in FIG. 7A.

A schematic of typical vertical gas atomizer 100 is shown in FIG. 7A. FIG. 7A is taken from R. Germain, Powder Metallurgy Science Second Edition MPIF (1994) (chapter 3, p. 101) and is included herein for reference. Vacuum or inert gas induction melter 102 is positioned at the top of free flight chamber 104. Vacuum induction melter 102 contains melt 106 which flows by gravity or gas overpressure through nozzle 108. A close up view of nozzle 108 is shown in FIG. 6B. Melt 106 enters nozzle 108 and flows downward till it meets high pressure gas stream from gas source 110 where it is transformed into a spray of droplets. The droplets eventually become spherical due to surface tension and rapidly solidify into spherical powder 112 which collects in collection chamber 114. The gas recirculates through cyclone collector 116 which collects fine powder 118 before returning to the input gas stream. As can be seen from FIG. 7A, the surroundings to which the melt and eventual powder are exposed are completely controlled.

There are many effective nozzle designs known in the art to produce spherical metal powder. Designs with short gas-to-melt separation distances produce finer powders. Confined nozzle designs where gas meets the molten stream at a short distance just after it leaves the atomization nozzle are preferred for the production of the inventive $L1_2$ aluminum alloy powders disclosed herein. Higher superheat temperatures cause lower melt viscosity and a more efficient disintegration of the molten stream into droplets resulting in smaller spherical particles.

A large number of processing parameters are associated with gas atomization that affect the final product. Examples include melt superheat, gas pressure, metal flow rate, gas type, and gas purity. In gas atomization, the particle size is related to the energy input to the metal. Higher gas pressures, higher superheat temperatures and lower metal flow rates result in smaller particle sizes. Higher gas pressures provide higher gas velocities and higher gas flow rates for a given atomization nozzle design.

To maintain purity, inert gases are used, such as helium, argon, and nitrogen. Helium is preferred for rapid solidification because the high heat transfer coefficient of the gas leads to high quenching rates and high supersaturation of alloying elements.

Figure 8A:
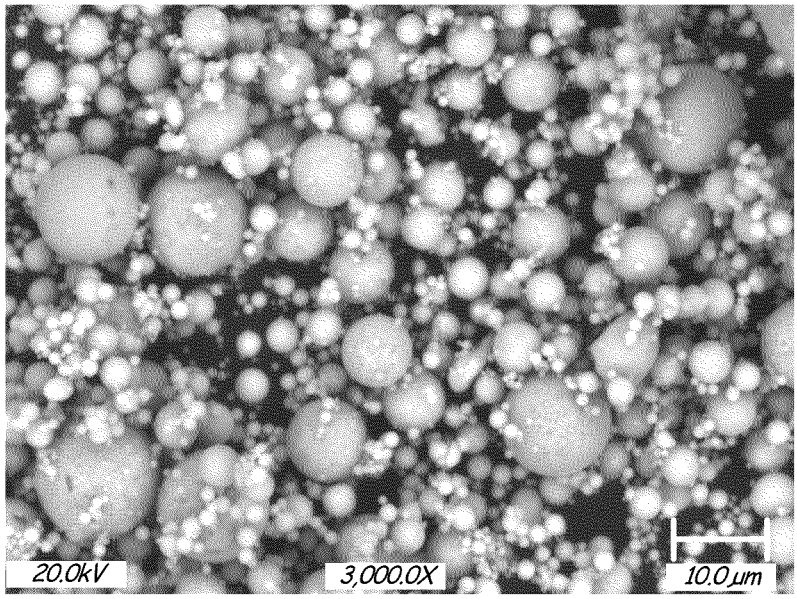
FIGS. 8A and 8B are SEM photos of the inventive aluminum alloy powder.
Figure 8B:
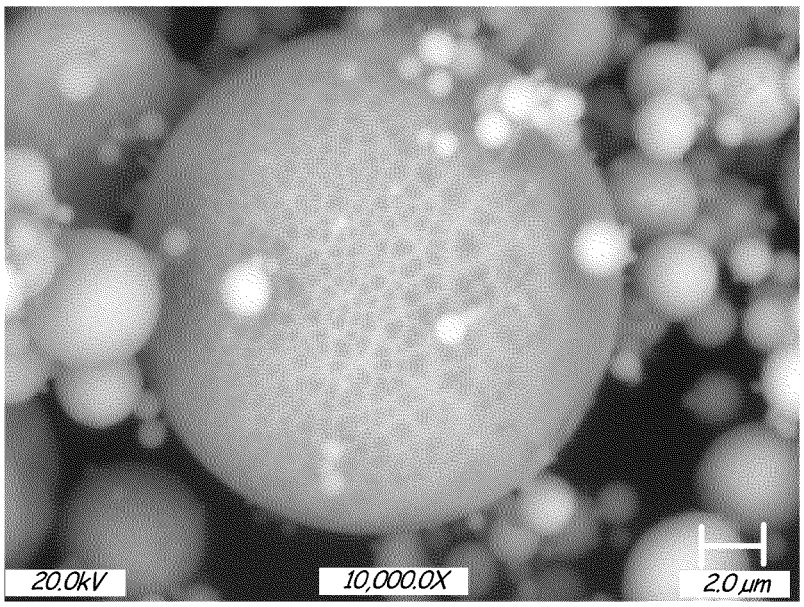
Figure 9A:
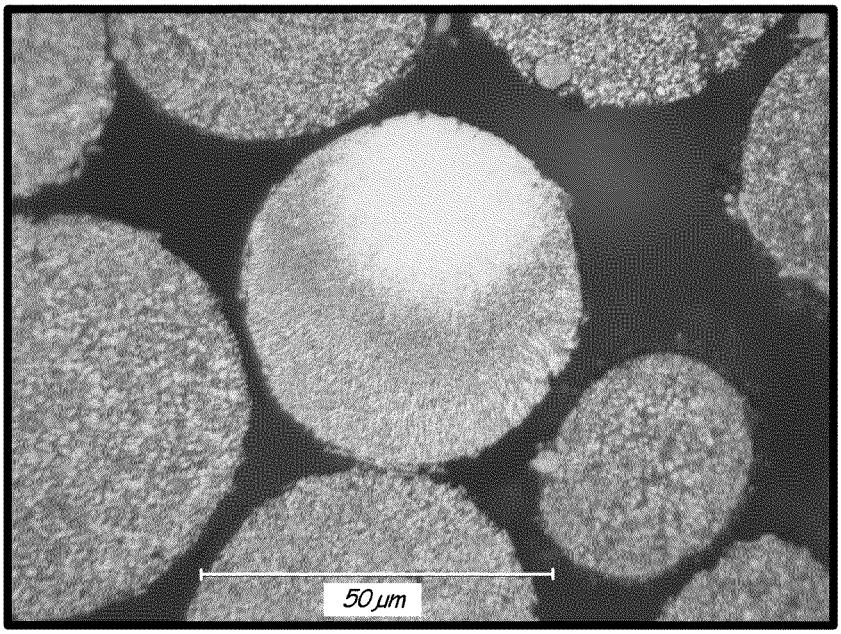
FIGS. 9A and 9B are optical micrographs showing the microstructure of gas atomized $L1_2$ aluminum alloy powder.
Figure 9B:
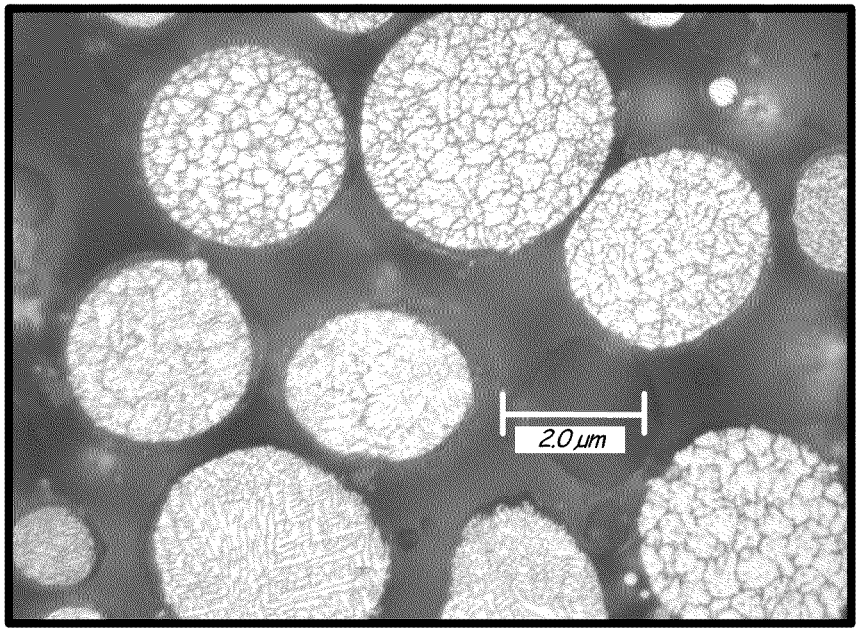
Figure 10:
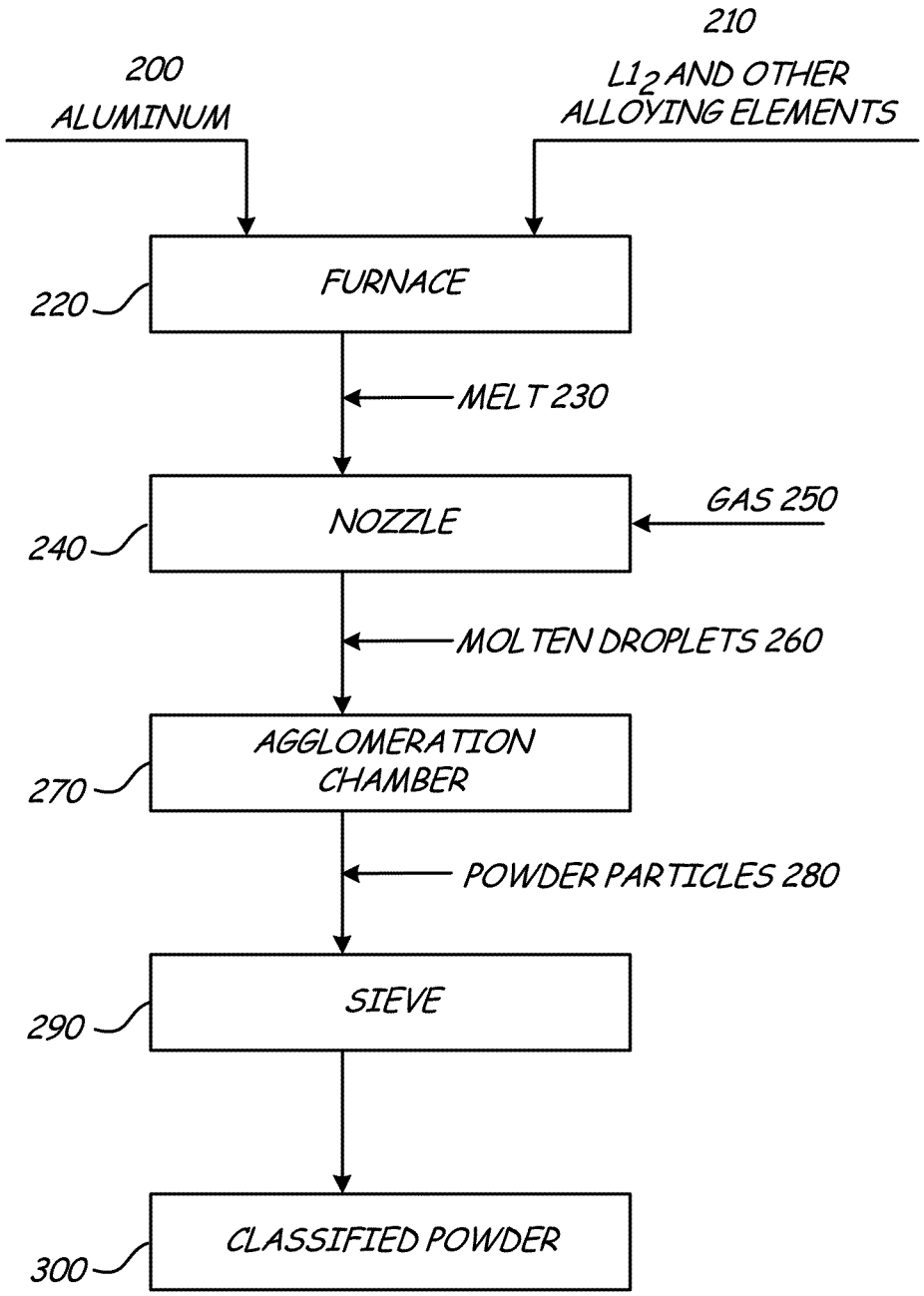
FIG. 10 is a diagram of the gas atomization process.

Lower metal flow rates and higher gas flow ratios favor production of finer powders. The particle size of gas atomized melts typically has a log normal distribution. In the turbulent conditions existing at the gas/metal interface during atomization, ultra fine particles can form that may reenter the gas expansion zone. These solidified fine particles can be carried into the flight path of molten larger droplets resulting in agglomeration of small satellite particles on the surfaces of larger particles. An example of small satellite particles attached to inventive spherical $L1_2$ aluminum alloy powder is shown in the scanning electron microscopy (SEM) micrographs of FIGS. 8A and 8B at two magnifications. The spherical shape of gas atomized aluminum powder is evident. The spherical shape of the powder is suggestive of clean powder without excessive oxidation. Higher oxygen in the powder results in irregular powder shape. Spherical powder helps in improving the flowability of powder which results in higher apparent density and tap density of the powder. The satellite particles can be minimized by adjusting processing parameters to reduce or even eliminate turbulence in the gas atomization process. The microstructure of gas atomized aluminum alloy powder is predominantly cellular as shown in the optical micrographs of cross-sections of the inventive alloy in FIGS. 9A and 9B at two magnifications. The rapid cooling rate suppresses dendritic solidification common at slower cooling rates resulting in a finer microstructure with minimum alloy segregation.

Oxygen and hydrogen in the powder can degrade the mechanical properties of the final part. It is preferred to limit the oxygen in the $L1_2$ alloy powder to about 1 ppm to 2000 ppm. Oxygen is intentionally introduced as a component of the helium gas during atomization. An oxide coating on the $L1_2$ aluminum powder is beneficial for two reasons. First, the coating prevents agglomeration by contact sintering and secondly, the coating inhibits the chance of explosion of the powder. A controlled amount of oxygen is important in order to provide good ductility and fracture toughness in the final consolidated material. Hydrogen content in the powder is controlled by ensuring the dew point of the helium gas is low. A dew point of about minus 50° F. (minus 45.5° C.) to minus 110° F. (minus 79° C.) is preferred.

In preparation for final processing, the powder is classified according to size by sieving. To prepare the powder for sieving, if the powder has zero percent oxygen content, the powder may be exposed to nitrogen gas which passivates the powder surface and prevents agglomeration. Finer powder sizes result in improved mechanical properties of the end product. While minus 325 mesh (about 45 microns) powder can be used, minus 450 mesh (about 30 microns) powder is a preferred size in order to provide good mechanical properties in the end product. During the atomization process, powder is collected in collection chambers in order to prevent oxidation of the powder. Collection chambers are used at the bottom of atomization chamber 104 as well as at the bottom of cyclone collector 116. The powder is transported and stored in the collection chambers also. Collection chambers are maintained under positive pressure with nitrogen gas which prevents oxidation of the powder.

Key process variables for gas atomization include superheat temperature, nozzle diameter, helium content and dew point of the gas, and metal flow rate. Superheat temperatures of from about 150° F. (66° C.) to 200° F. (93° C.) are preferred. Nozzle diameters of about 0.07 in. (1.8 mm) to 0.12 in. (3.0 mm) are preferred depending on the alloy. The gas stream used herein was a helium nitrogen mixture containing 74 to 87 vol. % helium. The metal flow rate ranged from about 0.8 lb/min (0.36 kg/min) to 4.0 lb/min (1.81 kg/min). The oxygen content of the $L1_2$ aluminum alloy powders was observed to consistently decrease as a run progressed. This is suggested to be the result of the oxygen gettering capability of the aluminum powder in a closed system. The dew point of the gas was controlled to minimize hydrogen content of the powder. Dew points in the gases used in the examples ranged from −10° F. (−23° C.) to −110° F. (−79° C.).

The powder is then classified by sieving (step 20 FIG. 6) to create classified powder. Powder sieving is performed under an inert environment to minimize oxygen and hydrogen pickup from the environment. While the yield of minus 450 mesh powder is extremely high (95%), there are always larger particle sizes, flakes and ligaments that are removed by the sieving. Sieving also ensures a narrow size distribution and provides a more uniform powder size. Sieving also ensures that flaw sizes cannot be greater than minus 450 mesh which will optimize the fracture toughness of the final product.

The role of powder quality is extremely important to produce material with higher strength, toughness and ductility. Powder quality is determined by powder size, shape, size distribution, oxygen content, hydrogen content, and alloy chemistry. Over fifty gas atomization runs were performed to produce the inventive powder with finer powder size, finer size distribution, spherical shape, and lower oxygen and hydrogen contents. Processing parameters of some exemplary gas atomization runs are listed in Table 1.

TABLE 1

Gas atomization parameters used for producing powder

| Run | Nozzle Diameter (in) | He Content (vol %) | Gas Pressure (psi) | Dew Point (° F.) | Charge Temperature (° F.) | Average Metal Flow Rate (lbs/min) | Oxygen Content (ppm) Start | Oxygen Content (ppm) End |
|---|---|---|---|---|---|---|---|---|
| 1 | 0.10 | 79 | 190 | <−58 | 2200 | 2.8 | 340 | 35 |
| 2 | 0.10 | 83 | 192 | −35 | 1635 | 0.8 | 772 | 27 |
| 3 | 0.09 | 78 | 190 | −10 | 2230 | 1.4 | 297 | <0.01 |
| 4 | 0.09 | 85 | 160 | −38 | 1845 | 2.2 | 22 | 4.1 |
| 5 | 0.10 | 86 | 207 | −88 | 1885 | 3.3 | 286 | 208 |
| 6 | 0.09 | 86 | 207 | −92 | 1915 | 2.6 | 145 | 88 |

It is suggested that the observed decrease in oxygen content is attributed to oxygen gettering by the powder as the runs progressed.

$L1_2$ aluminum alloy powder was produced with over 95% yield of minus 450 mesh (30 microns) which includes powder from about 1 micron to about 30 microns. The average powder size was about 10 microns to about 15 microns. Finer powder size is preferred for higher mechanical properties. Finer powders have finer cellular microstructures. Finer cell sizes lead to finer grain size by fragmentation and coalescence of cells during powder consolidation. Finer grain sizes produce higher yield strength through the Hall-Petch strengthening model where yield strength varies inversely as the square root of the grain size. It is preferred to use powder with an average particle size of 10-15 microns. Powders with a powder size less than 10-15 microns can be more challenging to handle due to the larger surface area of the powder. Powders with sizes larger than 10-15 microns will result in larger cell sizes in the consolidated product which, in turn, will lead to larger grain sizes and lower yield strengths.

Powders with narrow size distributions are preferred. Narrower powder size distributions produce product microstructures with more uniform grain size. Spherical powder was produced to provide higher apparent and tap densities which help in achieving 100% density in the consolidated product. Spherical shape is also an indication of cleaner and low oxygen content powder. Lower oxygen and lower hydrogen contents are important in producing material with high ductility and fracture toughness. Although it is beneficial to maintain low oxygen and hydrogen content in powder to achieve good mechanical properties, lower oxygen may interfere with sieving due to self sintering. An oxygen content of about 25 ppm to about 500 ppm is preferred to provide good ductility and fracture toughness without any sieving issue. Lower hydrogen is also preferred for improving ductility and fracture toughness. It is preferred to have about 25-200 ppm of hydrogen in atomized powder by controlling the dew point in the atomization chamber. Hydrogen in the powder is further reduced by heating the powder in vacuum. Lower hydrogen in final product is preferred to achieve good ductility and fracture toughness.

$L1_2$ Aluminum Alloy Powder Consolidation.

The process of consolidating the inventive alloy powders into useful forms is schematically illustrated in FIG. 6. $L1_2$ aluminum alloy powders (step 10) are first classified according to size by sieving (step 20). Fine particle sizes are required for optimum mechanical properties in the final part. Next, the classified powders are blended (step 30) in order to maintain microstructural homogeneity in the final part. Blending is necessary because different atomization batches produce powders with varying particle size distributions. The sieved and blended powders are then put in a can (step 40).

The can (step 40) is an aluminum container having, in this case, a rectangular configuration. The powder is then vacuum degassed (step 50) at elevated temperatures. Vacuum degassing times can range from about 0.5 hours to about 8 days. A temperature range of about 300° F. (149° C.) to about 900° F. (482° C.) is preferred. Dynamic degassing of large amounts of powder is preferred to static degassing. In dynamic degassing, the can is preferably agitated during degassing to expose all of the powder to a uniform temperature. Degassing removes oxygen and hydrogen from the powder. The role of dynamic degassing is to remove oxygen and hydrogen more efficiently than that of static degassing. Dynamic degassing is essential for large billets to reduce processing time and temperature.

Following vacuum degassing (step 50), the vacuum line is crimped and welded shut (step 60). The powder is then consolidated further by vacuum hot pressing (step 70) or by hot isostatic pressing (HIP) (step 80). Vacuum hot pressing will densify the canned powder providing the setup is one resembling blind die compaction. In blind die compaction, the ram and die both have an outline identical to the outline of the rectangular can thereby minimizing any lateral expansion during compaction. The resulting vertical compaction will completely densify the canned powder into a rectangular billet for subsequent deformation by rolling. Vacuum hot pressing of $L1_2$ aluminum alloy powder is carried out at temperatures from about 400° F. (204° C.) to about 900° F. (452° C.) to achieve full density.

Hot isostatic pressing (HIP) is carried out at elevated temperature in a closed chamber in which the work piece, the rectangular can filled with $L1_2$ aluminum alloy powder in this case, is exposed to high gas pressure in order to isostatically compress the can to full density. Prior to HIPing, the chamber is evacuated and back filled with gas, usually argon. The chamber is then brought up to temperature and pressurized. Standard HIP equipment is capable of pressures as high as 100 ksi (690 MPa). Hot isostatic pressing of $L1_2$ aluminum alloy powder is carried out at temperatures from about 400° F. (204° C.) to about 900° F. (482° C.) and at pressure from about 60 ksi (414 MPa) to about 100 ksi (690 MPa) and time ranging from about 0.5 hours to about 3 hours to achieve full density.

Rolling Consolidated Billets to Form $L1_2$ Aluminum Alloy Armor Plate.

Following high pressure consolidation (steps 70 or 80, FIG. 6), rectangular billet slabs are rolled into plate form (step 90). Before rolling, it is preferable to remove the aluminum cans by machining.

The rolling parameters used to fabricate armor plate included rolling temperature, reduction per pass, and intermediate heat treatments. Rolling temperatures ranged from about 400° F. (204° C.) to about 900° F. (482° C.). It is preferred to use rolling temperatures in the range of 650° F. (343° C.) to about 750° F. (399° C.) to produce the best mechanical properties. Higher temperatures resulted in lower strength and higher ductility whereas lower temperatures showed higher strength and lower ductility.

The material was heated for about 2 hours to about 8 hours depending on the thickness of material being rolled. Reduction in each rolling pass ranged from about 5% to about 40% with intermediate anneals. Lower reduction in each pass will take longer time to achieve desired reduction and therefore will be exposed to temperature for longer period which will reduce strength. Higher deformation per pass is desirable because it takes less time to roll the material and it is exposed to temperature for less time. A large reduction in each pass can cause cracking due to the increased amount of work hardening associated with large strain introduced from rolling. Based on experiments with the present inventive $L1_2$ aluminum alloys, it was found that 10-20% deformation in each pass is preferred.

It is preferred to anneal the part after each pass at selected rolling temperatures for about 15 minutes to 45 minutes to remove any work hardening caused by rolling deformation. Annealing temperatures ranged from about 400° F. (204° C.) to about 900° F. (482° C.). This helps in reducing the load requirement for further rolling of material as annealing cycle considerably softens the material.

While it may be preferred to use hot rolls for rolling, it is not essential for the present $L1_2$ alloys. For the present material, hot rolls were not used which required material to be annealed after each pass. During rolling, rolls having very large mass extract heat quickly from material and therefore, the material needs to be annealed after each pass in order to avoid cracking after hot pressing.

While direct rolling is a preferred approach for producing armor plates, direct forging and/or direct forging in combination with rolling can also be used.

The microstructure and resulting mechanical properties will be improved by rolling. The shear deformation the billet experiences during rolling will strip oxide coating off the powder allowing increased metal-to-metal contact resulting in a refined microstructure. In addition, the oxides will redistribute throughout the microstructure and provide additional Orowan barriers to deformation and result in increased strength. Armor plate (step 100) is formed by finishing the rolled product to final shape.

Figure 11:
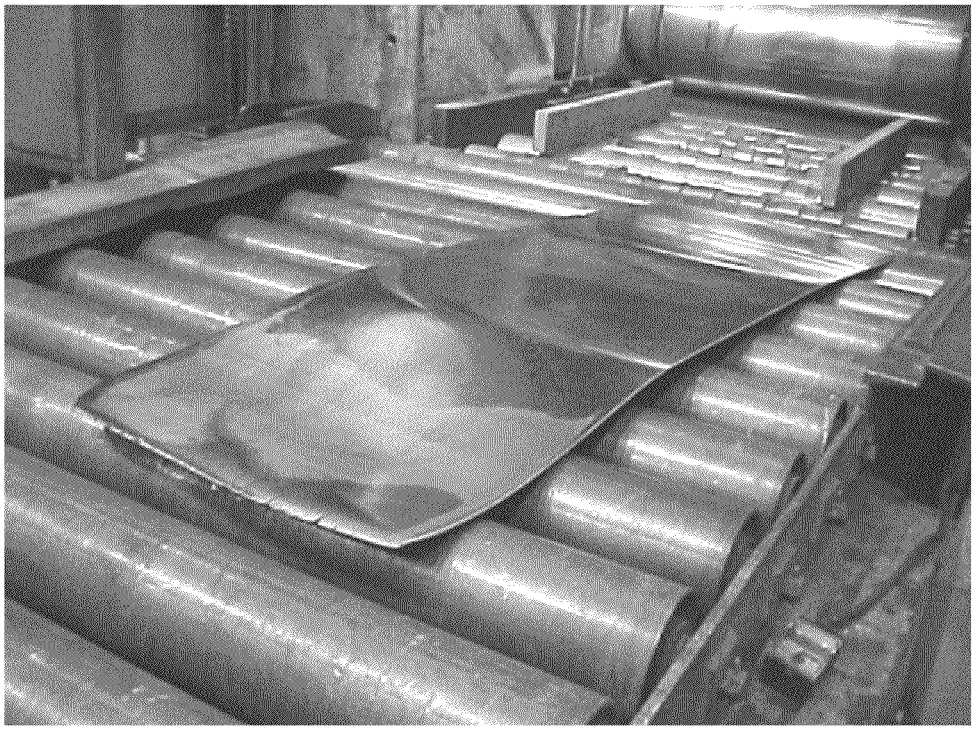
FIG. 11 is a photograph of rolled $L1_2$ high strength aluminum alloy sheet.

An example of a rolled $L1_2$ high strength aluminum alloy sheet is shown in FIG. 11. Rolling has been performed at temperatures up to 800° F. (427° C.) with good results. The mechanical properties of deformation processed $L1_2$ aluminum alloys are noticeably higher than the best prior art aluminum alloy armor. Table 2 lists the room temperature mechanical properties of three samples taken from an $L1_2$ aluminum alloy plate rolled at 700° F. (371° C.). Both yield strength and tensile strength of each example exceeded 75 ksi (517 MPa) indicating the suitability of this inventive material for lightweight armor applications. The strength of the present inventive material is significantly higher than aluminum alloys such as 5083, 2519 and 7039 which are currently used for armor applications.

TABLE 2

Room Temperature Tensile Properties of Rolled $L1_2$ Aluminum Alloy Plate

| Material ID # | Ultimate Tensile Strength, ksi (MPa) | Yield Strength, ksi (MPa) | Elongation, % | Reduction in Area, % |
|---|---|---|---|---|
| A | 91.5 (631) | 80.3 (554) | 5 | 10 |
| B | 91.1 (628) | 79.1 (545) | 6 | 11 |
| C | 92.0 (634) | 79.7 (550) | 4 | 8.5 |

Figure 12:
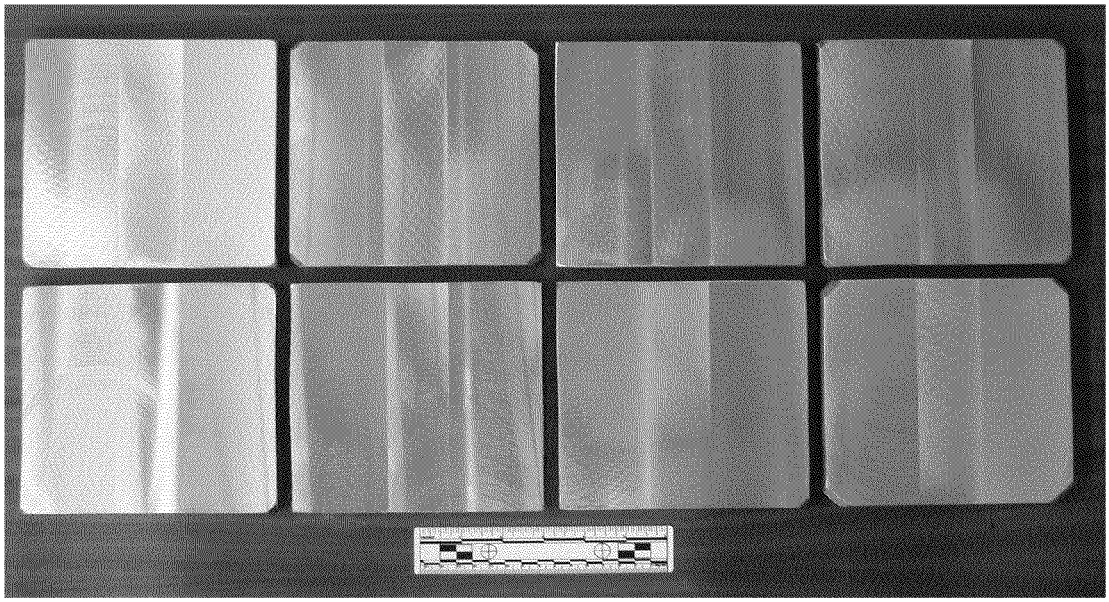
FIG. 12 is photograph of forged and machined plates of $L1_2$ aluminum alloy

FIG. 12 shows the photographs of forged plates. The plates are machined to the dimensions required for ballistic tests.

Figure 13A:
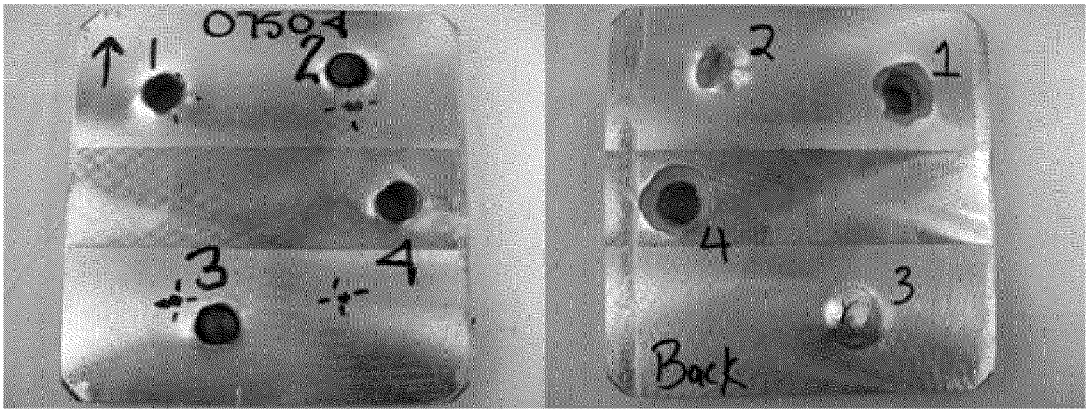
FIGS. 13A and 13B are photographs of ballistic tested plates with front and back view using 0.50 caliber fragment simulating projectiles (FSP) and 0.30 caliber armor piercing (AP) projectiles
Figure 13B:
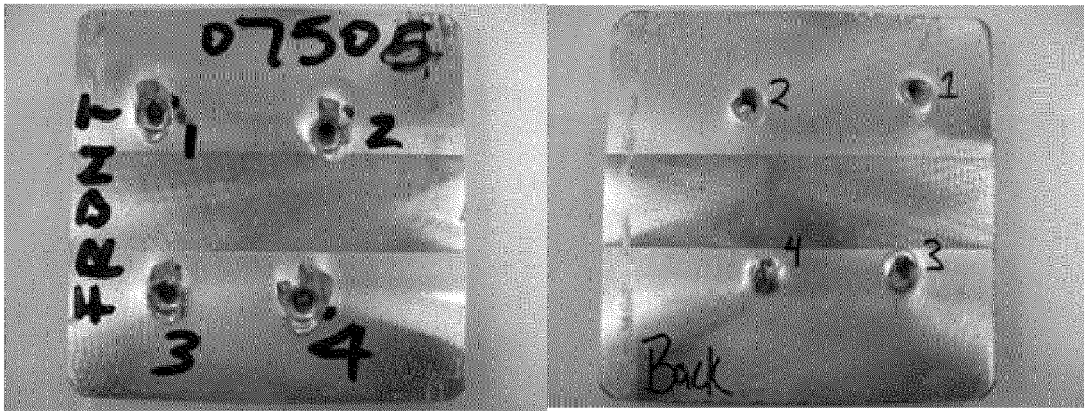

FIGS. 13A and 13B show the armor plates which were tested using 0.50 caliber fragment simulating projectile (FSP) and 0.30 caliber armor piercing (AP) projectiles at 30 degree obliquity, respectively. Testing was also performed with AP projectiles at 0 degree obliquity. There was no cracking and minimal spalling during ballistic tests which is consistent with state of the art aluminum alloy armor. The $V_{50}$ velocity results of the present inventive alloy showed over 20% higher protection than aluminum alloy 5083 which is currently used for armor application. $V_{50}$, the ballistic limits the ballistic velocity corresponding to 50% success of an armor plate defeating a projectile. The tests are run by firing projectiles at increasing velocities until 50% penetration is achieved.

Although the present invention has been described with reference to preferred embodiments, workers skilled in the art will recognize that changes may be made in form and detail without departing from the spirit and scope of the invention.

The invention claimed is:

1. A method for producing high strength aluminum alloy armor plate containing $L1_2$ dispersoids, comprising the steps of:

forming a powder containing $L1_2$ dispersoids in a matrix consisting of 4-25 weight percent silicon and the balance substantially aluminum, wherein the $L1_2$ dispersoids comprise:

$A1_3X$ dispersoids wherein X is at least one first element selected from the group consisting of about 0.1 to about 15.0 weight percent thulium, about 0.1 to about 25.0 weight percent ytterbium, and about 0.1 to about 25.0 weight percent lutetium; and at least one second element selected from the group consisting of about 0.1 to about 20.0 weight percent gadolinium, about 0.1 to about 20.0 weight percent yttrium, and about 0.05 to about 10.0 weight percent hafnium;

consolidating the powder into a billet with a rectangular cross-section having a density of about 100 percent; and hot working the billet to redistribute oxides throughout the microstructure, to provide additional Orowan barriers to deformation, and to reduce thickness to form armor plate having a yield strength and tensile strength in excess of 75 ksi (517 MPa).

2. The method of claim 1, wherein the aluminum alloy powder further contains at least one ceramic selected from the group comprising:

about 5 to about 40 volume percent aluminum oxide, about 5 to about 40 volume percent silicon carbide, about 5 to about 40 volume percent boron carbide, about 5 to about 40 volume percent aluminum nitride, about 5 to about 40 volume percent titanium boride, about 5 to about 40 volume percent titanium diboride, and about 5 to about 40 volume percent titanium carbide.

3. The method of claim 2, wherein the particle size of the ceramic is from about 0.5 to about 50 microns.

4. The method of claim 1, wherein the powder is formed by gas atomization.

5. The method of claim 4, wherein the gas used for gas atomization is helium, argon or nitrogen.

6. The method of claim 4, wherein the solidification rate during gas atomization is greater than $10^{3}$° C./second.

7. The method of claim 4, wherein the melt superheat temperature is from about 65° C. to about 95° C.

8. The method of claim 1, wherein consolidating the powder comprises:

sieving the powder to achieve a particle size of less than about −325 mesh;

placing the powder in a container with a rectangular cross-section;

vacuum degassing the powder;

sealing the container; and hot pressing the container to achieve a powder density of about 100 percent.

9. The method of claim 1, wherein hot working comprises at least forging or rolling.

10. The method of claim 9, wherein intermediate anneals is given between forging or rolling deformation to relieve work hardening to accommodate further deformation.

11. A high strength aluminum alloy armor plate containing:

$L1_2$ $A1_3X$ dispersoids in a matrix consisting of 4-25 weight percent silicon and the balance substantially aluminum, wherein X consists of:

at least one first element selected from the group consisting of about 0.1 to about 15.0 weight percent thulium, about 0.1 to about 25.0 weight percent ytterbium, and about 0.1 to about 25.0 weight percent lutetium; and at least one second element selected from the group consisting of about 0.1 to about 20.0 weight percent gadolinium, about 0.1 to about 20.0 weight percent yttrium, and about 0.05 to about 10.0 weight percent hafnium;

wherein the high strength aluminum alloy armor plate is formed by:

forming a powder containing the $L1_2$ $A1_3X$ dispersoids in the matrix;

consolidating the powder into a billet with a rectangular cross-section having a density of about 100 percent; and hot working the billet by rolling to redistribute oxides throughout the microstructure, to provide additional Orowan barriers to deformation, and to reduce thickness to form armor plate having a yield strength and tensile strength in excess of 75 ksi (517 MPa).

12. The high strength aluminum alloy armor plate containing $L1_2$ $A1_3X$ dispersoids of claim 11, wherein the powder further contains at least one ceramic selected from the group comprising: about 5 to about 40 volume percent aluminum oxide, about 5 to about 40 volume percent silicon carbide, about 5 to about 40 volume percent aluminum nitride, about 5 to about 40 volume percent titanium boride, about 5 to about 40 volume percent titanium diboride, and about 5 to about 40 volume percent titanium carbide.

13. The high strength aluminum alloy armor plate containing $L1_2$ $A1_3X$ dispersoids of claim 11, wherein the aluminum alloy powder is formed by gas atomization.

14. The high strength aluminum alloy armor plate containing $L1_2$ $A1_3X$ dispersoids of claim 12, wherein the particle size of the ceramic is from about 0.5 to about 50 microns.

15. The high strength aluminum alloy armor plate containing $L1_2$ $A1_3X$ dispersoids of claim 11, wherein consolidating the powders comprises:

sieving the powders to achieve a particle size of less than about −325 mesh;

placing the powders in a container with a rectangular cross-section;

vacuum degassing the powder;

sealing the container; and hot pressing the container to achieve a powder density of about 100 percent.

16. The high strength aluminum alloy armor plate containing $L1_2$ $A1_3X$ dispersoids of claim 11, wherein hot working comprises at least forging or rolling.

17. The high strength aluminum alloy armor plate containing $L1_2$ $A1_3X$ dispersoids of claim 15, wherein intermediate anneals are given between forging or rolling treatments to relieve work hardening to accommodate further deformation.

* * * * *

UNITED STATES PATENT AND TRADEMARK OFFICE

CERTIFICATE OF CORRECTION

PATENT NO. : 9,127,334 B2
APPLICATION NO. : 12/437183
DATED : September 8, 2015
INVENTOR(S) : Awadh B. Pandey It is certified that error appears in the above-identified patent and that said Letters Patent is hereby corrected as shown below:

IN THE CLAIMS

Col. 14, Line 59
Delete "aluminum alloy"

Signed and Sealed this
Tenth Day of May, 2016

Michelle K. Lee

Michelle K. Lee
*Director of the United States Patent and Trademark Office*